United States Patent [19]

Heath

[11] Patent Number: 4,909,414

[45] Date of Patent: Mar. 20, 1990

[54] DEVICE TO REMOVE OBJECTS FROM BLISTER PACKS

[76] Inventor: Clarence Heath, P.O. Box 908, Caguas, P.R. 00626

[21] Appl. No.: 350,293

[22] Filed: May 9, 1989

[51] Int. Cl.[4] ..... B26D 1/02; B65B 69/00

[52] U.S. Cl. ..... 221/25; 414/412

[58] Field of Search ..... 221/25, 30, 31; 83/856; 414/412

[56] References Cited

U.S. PATENT DOCUMENTS 3,215,179 11/1965 Schill ..... 83/856

3,482,733 10/1965 Groves ..... 221/25

*Primary Examiner*—F. J. Bartuska

*Assistant Examiner*—Glenn L. Heinl

*Attorney, Agent, or Firm*—William Nitkin

[57] ABSTRACT

A device for the removal of objects from blister packs, such device having a track member with a plurality of channels defined therein aligned with the columns of blisters of the blister pack to receive such blisters therein and a blade member disposed in a plane parallel to the surface of the track member and perpendicular to the plane along the length of the channels with a serrated roller to drive the blister pack against the blade member to slice off the blisters above the objects but below the planar back member of the blister pack.

2 Claims, 1 Drawing Sheet

DEVICE TO REMOVE OBJECTS FROM BLISTER PACKS

BACKGROUND OF THE INVENTION

1. Field of the Invention

The device of this invention relates to the removal of objects from blister packs both pushed through and tamper proof type, and more particularly relates to a mechanized device for quick and speedy removal of a plurality of objects including, but not limited to, pills and capsules from planar blister packs, such objects arrayed in columns and rows within individual blisters.

2. Description of the Prior Art

Objects such as pills and capsules are frequently packaged individually in blister packs which are convenient and in the case of pills and capsules helps to keep the pills clean and discourages tampering. However many times it is desirable to remove objects in bulk from such blister packs. For example, if objects are incorrectly packaged, they must be removed from such blister packaging if they are to be salvaged. At present objects are removed from such blister packs slowly by manual labor. The objects are cut by hand from each blister in the pack individually with pen knives, one at a time which process is very time-consuming and costly.

SUMMARY OF THE INVENTION

It is an object of this invention to provide a device for the speedy and inexpensive removal of a large quantity of objects which are individually packaged in blister packs without the need to cut each blister individually to remove the object contained therein.

To accomplish the desired goals of this invention, a plurality of blister packs each containing a plurality of columns and rows of objects disposed on a planar pack member, each covered with a blister portion which may be plastic, the base of which may extend over the entire area of the planar pack, is operated upon by the device of this invention. Frequently such blister packs have serrations in the planar pack member to allow users to separate one object in its blister and accompanying portion of the planar member from the entire pack.

In operation the device of this invention has a receipt member with a plurality of channels defined of a size to receive the column of blisters with each channel being aligned with a column of blisters on the pack from which the objects are to be removed. The blister pack is placed with the objects in their blisters disposed downwards, each column of objects within its separate channel. The package is moved forward and passed under a serrated roller which securely grips the pack and drives such pack under the rotating roller which drives the pack forward moving the blisters within the channel in which they are traveling. A blade is disposed under the serrated roller above the tops of the channels at an 8° angle which is adapted to slice into the blister at their junction with the planar pack member and to pass between the contained objects and the planar pack member so as to cut an entire row of blisters each containing an object from the planar pack member. The resulting blisters, each containing an object, may be then processed further and the objects separated from the blisters by hand or vibrating them on a mechanical screen having apertures of a size to receive only the objects, thus separating the objects from the cut blisters. The serrated roller is driven by a geared motor drive so that the roller has sufficient force to drive each row of blisters against the blade which extends under such roller. By use of this device the objects can be speedily removed from blister packs at a rate 50 to 100 times faster than removing objects by cutting the blisters by hand depending upon the number of blisters in each row. Once removed from the blister packaging, the objects can be used or repackaged as desired.

DESCRIPTION OF THE PREFERRED EMBODIMENT(S)

Figure 1:
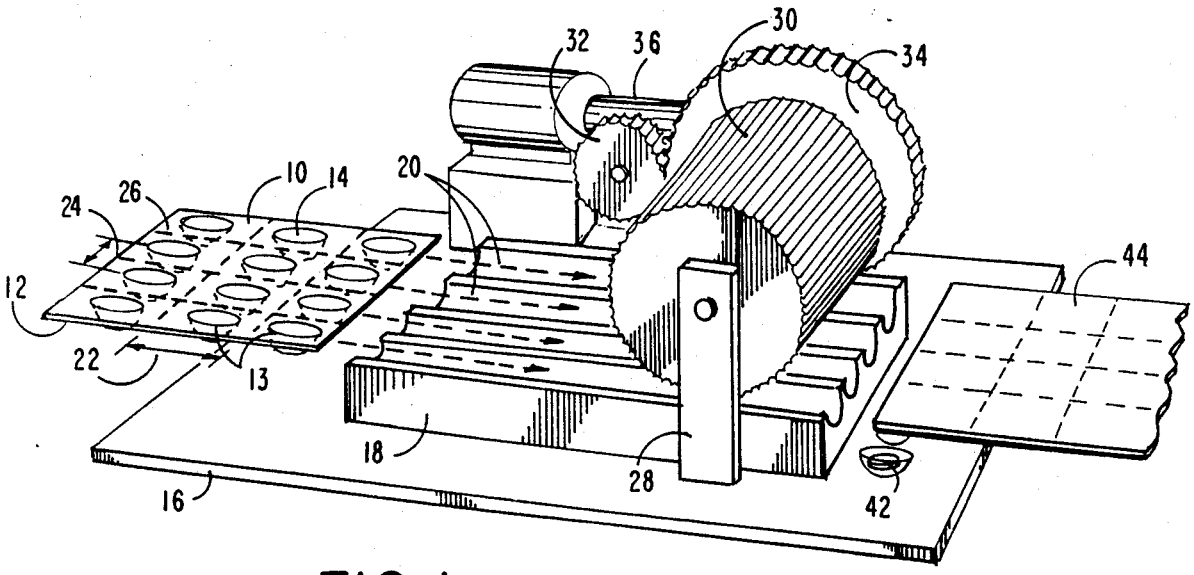
FIG. 1 illustrates a perspective view of the device of this invention.

FIG. 1 illustrates a perspective view of blister pack 10 which at bottom 12 has a plurality of blisters 13, each containing an object 14, such as a pill or capsule, arrayed in a plurality of columns 22 in a plurality of rows 24. Each individual object could be separated by perforations 26 from the adjacent objects contained within other blisters. Such planar blister packs are well known, and the goal of this invention is to remove the objects, such as for example pills or capsules, contained within blisters 13 safely and quickly therefrom. Seen in FIG. 1 is base 16 on which is mounted track member 18 which can be made of hard anodized aluminum or equivalent wear-resistant material having a plurality of channels 20 defined therein. The size and distances apart of the channels correspond to the size of the blisters in each column 22 of the blister pack so that when the blister pack is placed over the columns of track member 18, each column of blisters will align and fit into a channel 20 so that the blister pack can be moved along the channels manually until it reaches roller 30. Roller 30 is positioned above and perpendicular to the length of the channels and can have a plurality of serrations around its entire outer surface. The roller can be made of a heat-treated, chrome-plated steel or hard anodized aluminum or equivalent wear-resistant material. Roller 30 is rotatably mounted on an axle within a pair of support members 28, only one of which is depicted in FIG. 1. Roller 30 can be rotated by geared wheel 34 driven by smaller geared wheel 32 which is driven by variable-speed geared motor 36. Other equivalent means of rotating roller 30 can be utilized. In this way the blister pack can be manually advanced, blisters facing downward, along track member 18 which track member can be made of an anodized aluminum. The leading edge of the pack is then pushed under serrated roller 30 until the serrations of roller 30 start to securely grip and move the blister pack thereunder against blade 40 as seen in FIG. 2.

Figure 2:
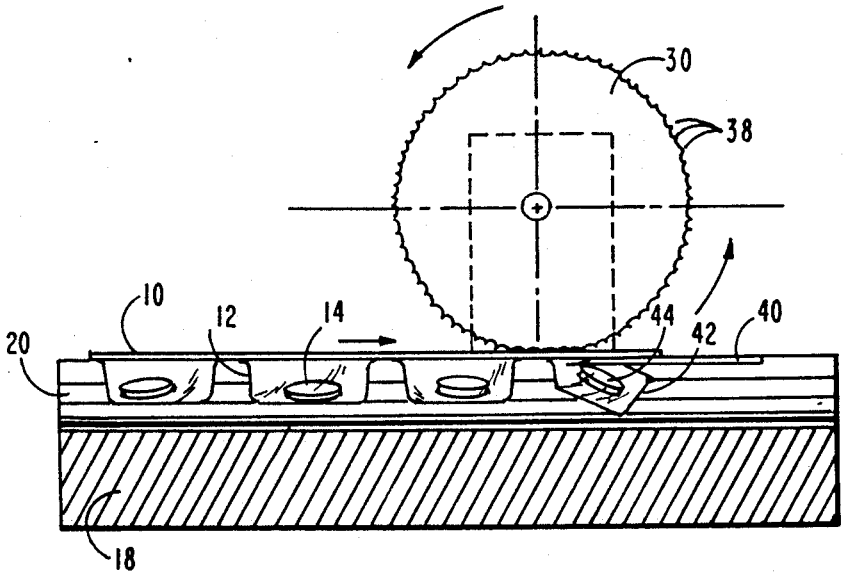
FIG. 2 illustrates a cutaway side elevational view of the device of this invention showing a channel and a blister column therein with the first blister in the column being driven against the blade member by the serrated roller.

FIG. 2 is a side elevational cutaway view showing roller 30 with the plurality of serrations 38 therearound grasping the top of blister pack 10 and driving blister 42 against blade 40. Blade 40 is positioned in a plane generally parallel to the surface of track member 18 and generally perpendicular to the plane along the length of channels 20. Blade 40 enters and cuts through a row of blisters, passing above object 44, which in this case is a pill, and out of the blister at its rear end, not shown, as blister pack 10 advances in the direction of the arrow through the machine. Each object, such as pill 44 and separated blister 42 then fall to the bottom of channel 20 and serrated wheel 30 continues to rotate until the next row of objects in blisters reaches blade 40 where the blisters are again cut through and separated from the blister pack by the action of the blade 40 passing through the top of each blister just under the planar member and above each object. The plurality of objects contained within the blisters then fall to the bottom of channels 20 and can fall out of the channel by gravity to a collection station, not shown, where they can be later separated by hand or by vibrating means so that the objects can be collected and/or repackaged.

It should be noted that for each blister pack configuration which may have different sized arrays of columns and rows and different blister depths, appropriately sized channels and channel spacings would be used in the track member to accommodate such different sized blister packs. It should be further noted that the device of this invention can operate on blisters containing any object such as locks, toys, pills or capsules and the use of this device is not designed for any one particular object. For each object an appropriate separation means to separate the objects from the cut blisters can be utilized such as a screen with holes small enough to let small objects pass through while at the same time retaining the larger blisters; or blisters can be removed by principal of static electricity.

Although the present invention has been described with reference to particular embodiments, it will be apparent to those skilled in the art that variations and modifications can be substituted therefor without departing from the principles and spirit of the invention.

I claim:

1. A device for the removal of objects from blister packs of the type having a planar member on one side and a plurality of blisters on the other side, each blister of a depth to hold such object, said blisters arrayed in columns and rows, said planar member of said blister pack having a front leading edge, said device comprising:

a track member having a plurality of parallel channels defined in the top thereof, each channel being of a depth equivalent to the depth of said blisters in each column of said blister pack, said plurality of channels spaced apart from one another a distance equivalent to the distance between the columns of blisters on said blister pack, said channels being aligned so that the blisters when placed thereon longitudinally in the direction of the columns will align the blisters in the channels positioning the planar member of the blister pack at the top of said track member;

a blade member disposed generally perpendicular to the plane along the length of said channels and disposed at the top of said channels;

a roller rotatably postioned perpendicular to the length of said channels and positioned in front of said blade a distance sufficient to receive the front leading edge of said blister pack; and means to rotate said roller to drive said blister pack with said blisters facing down thereunder against said blade member which cuts each row of blisters at a point just beneath said planar member yet above each object held within each blister so that the blisters and the objects contained therein fall to the bottom of the channels for later collection and removal of the objects from each blister.

2. The device of claim 1 wherein said roller contains a plurality of serrations positioned on its outer surface.

* * * * *